United States Patent [19]

Sheiman et al.

[11] 4,141,107

[45] Feb. 27, 1979

[54] HINGE CLIP

[75] Inventors: Samuel R. Sheiman, Brooklyn; Julius Sheiman, North Woodmere, both of N.Y.

[73] Assignee: Crest Lock Company, New York, N.Y.

[21] Appl. No.: 825,088

[22] Filed: Aug. 16, 1977

[51] Int. Cl.[2] ..... E05D 3/00

[52] U.S. Cl. ..... 16/128 R; 248/74 B; 248/300; 248/DIG. 9

[58] Field of Search ..... 248/74 R, 74 B, 300, 248/247, DIG. 9, 459, 231; 16/128 R, 168, 169; 29/150

[56] References Cited

U.S. PATENT DOCUMENTS

| | | | |
|---|---|---|---|
| 1,365,629 | 1/1921 | Lieb | 248/74 R |
| 1,409,663 | 3/1922 | Burns | 16/128 R |
| 2,252,571 | 8/1941 | Kohn | 248/459 |
| 2,396,838 | 3/1946 | Ellinwood | 248/74 B X |
| 2,638,643 | 5/1953 | Olson | 248/300 X |
| 2,873,091 | 2/1959 | Kinsman | 248/300 X |
| 3,008,175 | 11/1961 | Biedinger et al. | 16/128 R |
| 3,123,329 | 3/1964 | Pruehs | 248/74 R |
| 3,216,691 | 11/1965 | Fradin | 29/150 X |
| 4,037,810 | 7/1977 | Pate | 248/74 R X |

*Primary Examiner*—Rodney H. Bonck
*Attorney, Agent, or Firm*—Kirschstein, Kirschstein, Ottinger & Cobrin

[57] ABSTRACT

A clip consisting of a single strip of a strong metal such as steel having two legs at right angles and joined by a U-bend, one leg of the clip being a coplanar extension of one arm of the U-bend and the other leg of the clip extending away from the U-bend in a plane perpendicular to that of the other arm. Each clip leg has one or more openings. The clip is marketed in this shape. To use the clip, the clip leg that is coplanar with an arm of the U-bend is bent at the junction between said coplanar leg and arm to bring the two clip legs into juxtaposition, at which time the openings in the two legs are registered with each other, whereupon the clip is ready for installation. To enable the aforesaid clip leg to be bent precisely, a locating structure, e.g. a brace, is disposed at the junction between the coplanar leg and arm.

8 Claims, 6 Drawing Figures

HINGE CLIP

BACKGROUND OF THE INVENTION

1. Field of the Invention

A clip.

2. Description of the Prior Art

Heretofore clips constituted a metal strap shaped to provide two legs joined by a U-bend. One leg was a coplanar extension of one arm of the U-bend. The other leg was perpendicular to the other arm of the U-bend. Prior to using the clip, the coplanar leg was bent at its junction with the associated arm of the U-bend in order to bring said legs in face-to-face contact. Both legs had preformed openings to pass elements that were to attach the clip to an item. These openings were supposed to be in registry after bending but this was difficult to accomplish, because the line of bending was not precisely predeterminable. The bending had to be readjusted, or a jig had to be used, or the openings had to be repunched, or the openings were omitted in the clip and were punched after the bending had been performed. All these procedures were time-consuming and expensive.

SUMMARY OF THE INVENTION

1. Purposes of the Invention

It is an object of the present invention to provide an improved clip.

Another object is to provide an clip which can easily be accurately and precisely bent to a desired configuration, with previously formed openings in the clip in registration after bending.

A further object is to provide an clip which is readily attached to a pintle and to a piece of luggage.

An additional object is to provide a clip with an arrangement to permit the clip to be precisely bent.

These and other objects and advantages of the present invention will become evident from the description which follows.

2. Brief Description of the Invention

A clip for attachment to a pintle or other element. The clip has two legs and a middle U-shaped section. One of the legs is a coplanar extension of an arm of the U-shaped section. The other leg is perpendicular to the other arm of the U-shaped section. Various configurations are employed for expediting right angled bending of the clip at the junction between the leg of the clip and the coplanar arm of the U-shaped section. The folding structure may be a brace, a score line, a tab or a crease or combinations thereof, and in any case the structure for accurate and precise bending of the clip at the aforementioned junction includes a reinforcing member for the bent leg thereby insuring accurate placement of the right angled bend. The two legs of the clip have preformed openings that are readily brought into registration by bending the clip at said junction.

The present clip thus consists of a flat elongated metal strip having two legs at right angles to each other and an intermediate U-shaped section with parallel arms. The legs are so joined by the U-shaped section that one leg of the strip is a coplanar extension of one arm of the U-shaped section, and the other leg of the strip is perpendicular to the other arm of the U-shaped section and extends away from the first leg of the strip. Each of the legs of the strip has at least one opening and it is required that the openings be in registration when the clip is installed, after bending the other leg into face-to-face juxtaposition with the one leg. To accomplish this registration in an improved manner, specific means for locating the bend is disposed at the junction between the first leg of the strip and the coplanar arm of the U-shaped section, said means including a member for bracing the first leg in its as-bent position.

The bend locating means is transverse to the longitudinal axis of the strip, and typically constitutes a score line and a brace mounted on the strip. The score line typically is a rectilinear slot formed by coining an angular lip from the surface of the strip, the slot and juxtaposed lip extending perpendicularly to the longitudinal axis of the strip. The free edge of the lip (the edge remote from the edge lying in the plane of the strip) is positioned to be braced against an arm of the U-shaped section when the clip is bent whereby to precisely position this arm and hence the leg carried by the opposite arm of the U-shaped section so that the as-bent positions of the two legs of the clip is determined in advance with accuracy and the openings in said legs will be in the desired registry.

Typically, the strip is composed of a strong metal such as steel or brass. In a preferred embodiment, the number of openings in each leg of the strip is two, and it is preferred that the openings be on the central longitudinal axis of the strip.

The present clip is preferably a hinge clip employed to attach a pintle to a piece of luggage.

The present clip provides several salient advantages. The clip is readily and rapidly installed in service, since the openings in the legs of the clip are immediately aligned in registration when the clip is bent for usage. The bend locating means at the junction between the coplanar legs of the clip and U-shaped section is readily and cheaply provided during fabrication of the clip, so that the present clip may readily be mass-produced at low cost. There are no detachable parts to the present clip, so nothing can be lost in transit or handling of the clip. Finally, the present clip may be readily attached to any sort of pintle as well as to a piece of luggage.

The invention accordingly consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings in which are shown several of the various possible embodiments of the invention.

DETAILED DESCRIPTION OF THE PREFERRED EMBODIMENTS

Figure 1:
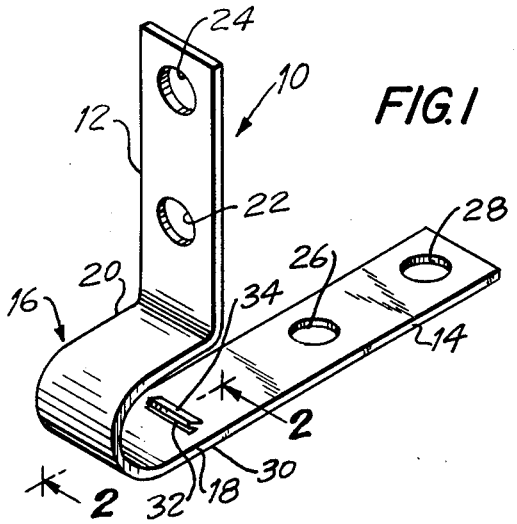
FIG. 1 is a perspective view of one embodiment of the new hinge clip in form.
Figure 2:
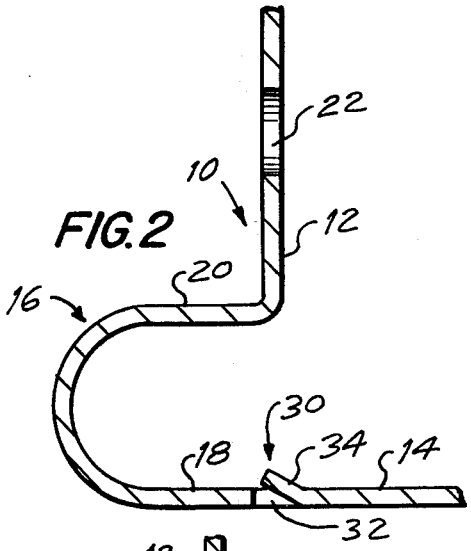
FIG. 2 is a sectional view taken substantially along the line 2—2 of FIG. 1.

Referring now to FIGS. 1 and 2, one embodiment of the present hinge clip is shown. The clip is a strip 10 which is characterized by the provision of two legs 12 and 14, which are in planes at right angles to each other as best shown in FIG. 2, and a middle or central U-bend 16 which joins the two legs 12 and 14. The leg 14 is a coplanar extension of one arm 18 of the U-bend 16, while the other leg 12 extends away from the U-bend 16 in a plane perpendicular to that of the other arm 20 of the U-bend 16.

The clip leg 12 is provided with two openings 22 and 24 which are aligned along the central longitudinal axis of the leg 12, and the clip leg 14 is provided with corresponding two openings 26 and 28 which are aligned along the central longitudinal axis of the leg 14. The objective of the present invention is to bend the clip leg 14 in such a manner that opening 26 is aligned in exact superimposition with opening 22, and opening 28 is aligned in exact superimposition with opening 24, when the clip leg 14 is bent relative to the U-bend 16 towards leg 12 until leg 14 is substantially perpendicular to arm 18.

In order to accomplish this registration of the openings, and in accordance with the present invention, a projection is provided on the strip at the junction 30 between the leg 14 and the arm 18. The projection in this case is formed by providing a score line 32 which in this embodiment of the invention is a rectilinear slot formed by coining a rectilinear lip 34 from the surface of the strip 10, the slot or score line 32 and juxtaposed lip 34 extending substantially perpendicularly to a longitudinal edge or the longitudinal axis of the strip 10.

Figure 3:
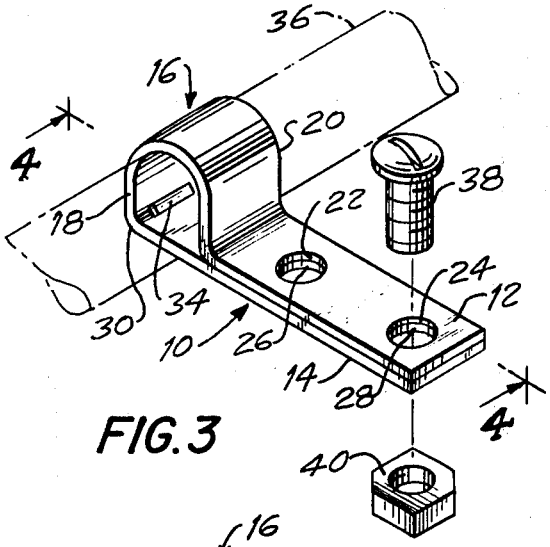
FIG. 3 shows the clip of FIGS. 1 and 2 in perspective after being bent to receive a pintle.
Figure 4:
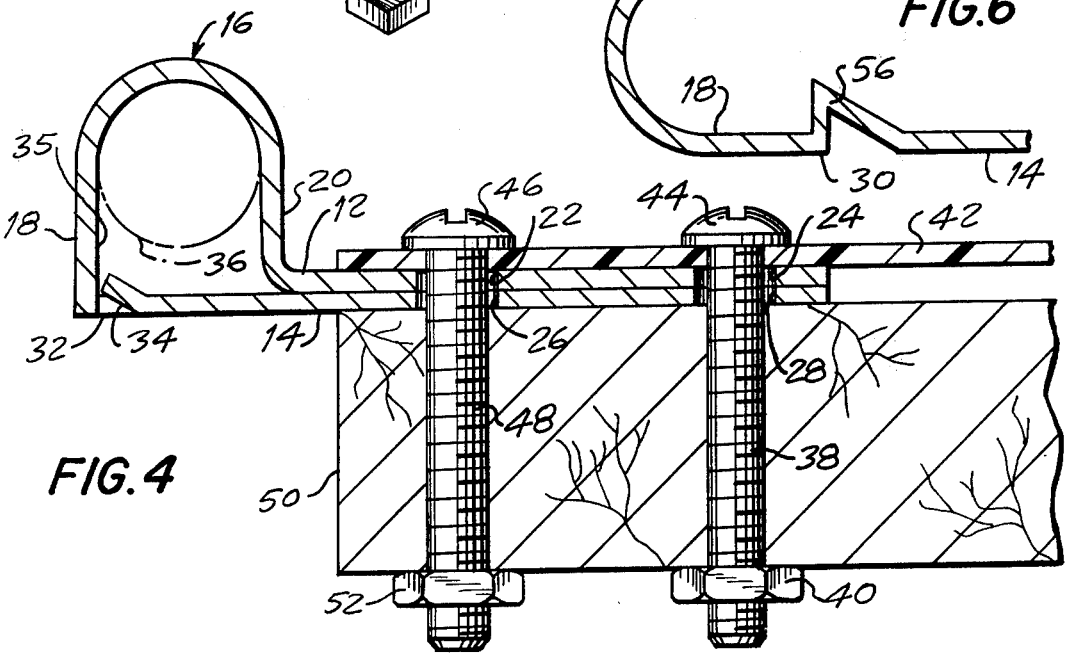
FIG. 4 shows the clip of FIG. 3 as installed and is, in part, a sectional view taken substantially along the line 4—4 of FIG. 3.

The strip 10 is manually bent, or bent with the usage of a tool, so that as shown in FIGS. 3 and 4, leg 14 bends about arm 18 at junction 30 due to the provision of the lip 34 and slot or score line 32, which assures that the bending will take place precisely as desired so as to attain registration of openings 22 and 26, and openings 24 and 28. In this case, as best shown in FIG. 4, after bending, the lip 34 acts as a brace by contacting arm 18, to properly align the legs 12 and 14. Thus the abutment of the lip 34 against the inner surface 35 (FIG. 4) of arm 18 serves to define and properly orient the bend in the correct and exact position required. FIG. 3 shows a pintle 36 in phantom outline extending through the U-bend 16, and FIG. 4 shows the pintle 36 disposed coaxially within the circular portion of the U-bend 16. FIG. 3 also shows, in exploded view, a threaded bolt 38 and a nut 40, used for final installation of the clip. It will be evident in comparing FIGS. 2 and 3, that the clip is readily initially installed about the pintle 36 while in the configuration of FIG. 2, the as-sold condition. Thereafter, the clip is bent to the FIGS. 3 and 4 disposition. FIG. 4 also shows the clip appurtenances which are present when the clip is installed on a piece of luggage so that the pintle 36 is connected to the luggage. Thus a layer or sheet 42 consisting of plastic or leather is disposed immediately below the head 44 of the bolt 38 and the head 46 of a bolt 48 which extends through the registered openings 22 and 26. Similarly, bolt 38 extends through the registered openings 24 and 28. A block or layer 50 of wood, paperboard or the like is held below leg 14 and within the piece of luggage by nut 40 screwed on bolt 38 and a nut 52 screwed on bolt 48.

Figure 5:
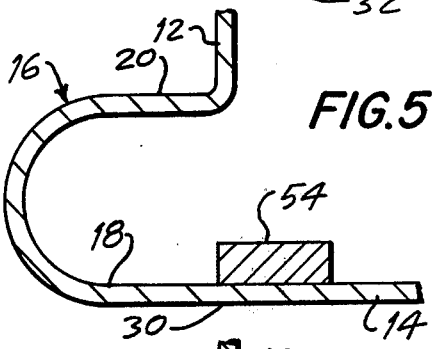
FIG. 5 is a sectional view of a modified form of hinge clip embodying the invention.
Figure 6:
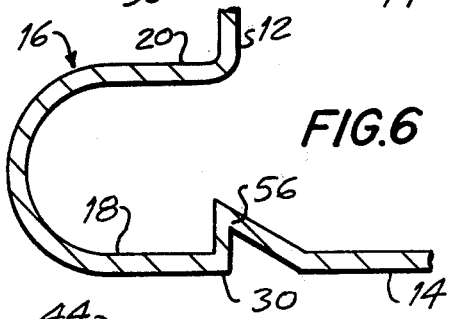
FIG. 6 is a sectional view of another modified form of hinge clip embodying the invention.

FIG. 5 shows an alternative embodiment of the invention in which a tab 54 is disposed on the inner surface of leg 14 at the junction 30, to function in a manner similar to the slot 32 and lip 34 described supra. In this case, after bending (not shown), the tab 54 acts as a brace. FIG. 6 shows another alternative embodiment in which a crease 56 is coined in the surface of the leg 14 at the junction 30. The crease 56 also functions in a manner similar to tab 54 or slot 32 and lip 34.

It thus will be seen that there is provided an hinge clip which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. For use in forming a hinge clip that is to be employed to attach a pintle to a member, an element comprising:

(A) a flat elongated strip,
  (i) said strip having a first leg and a second leg,
  (ii) said legs lying in planes at right angles to each other, and
(B) an intermediate U-shaped section,
  (i) said U-shaped section constituting a semicircular base,
  (ii) a first arm, and
  (iii) a second arm,
  (iv) said arms being mutually parallel to each other,
  (v) said arms being unitary extensions of the ends of said base,
(C) said intermediate U-shaped section unitarily joining said first leg to said second leg,
(D) the first leg of said strip being a co-planar extension of one arm of said U-shaped section,
(E) the second leg of said strip being substantially perpendicular to the other arm of said U-shaped section,
(F) each of said first and second legs of said strip having a different opening therein,
(G) said element being bendable about the zone between said one arm and said first leg,
(H) means within said zone for locating the bend, said means being so disposed that said openings are in registration after bending,
(I) said locating means including a bearing member positioned to be contacted by the inner surface of a segment of the first arm when said leg is perpendicular to the first arm whereby to act as a brace that defines and orients the first leg in perpendicular relation to the first arm, and
(J) the element, after bending around a pintle, constituting said first leg and said second leg juxtaposed in abutting relationship with said openings in registration, with said U-shaped section extending away from the proximate ends of the two legs, with the proximate ends of the two legs spaced apart lengthwise by the distance between said two arms, and with the U-shaped section extending perpendicularly away from the two juxtaposed legs, each arm of the U-shaped section in bent position of the element being perpendicular to the associated leg.

2. The element of claim 1 in which the locating means is a projection on the strip at the junction between the first leg and the one arm, said projection extending toward the other arm.

3. The element of claim 1 wherein a score line is provided at the junction between the first leg and the one arm.

4. The element of claim 3 in which the score line is a rectilinear slot parallel to a rectilinear lip which has been coined from the surface of the strip, said slot and juxtaposed lip extending substantially perpendicularly to the longitudinal edge or axis of said strip.

5. The element of claim 1 in which the locating means is a tap mounted on the strip.

6. The element of claim 1 in which the locating means is a crease in the surface of the strip.

7. The element of claim 1 in which the number of openings in each leg of the strip is two.

8. The element of claim 1 in which the openings are on the central longitudinal axis of the strip.

* * * * *